US005894456A

United States Patent [19]

Schneider

[11] Patent Number: 5,894,456

[45] Date of Patent: Apr. 13, 1999

[54] TIMEPIECE INCLUDING LUMINOUS ELEMENTS

[75] Inventor: Rolf Schneider, Bienne, Switzerland

[73] Assignee: Eta SA Fabriques D'Ebauches, Grenchen, Switzerland

[21] Appl. No.: 08/960,436

[22] Filed: Oct. 29, 1997

[30] Foreign Application Priority Data

Nov. 1, 1996 [CH] Switzerland ..... 2706/96

[51] Int. Cl.[6] ..... G04B 19/30; G04B 37/00

[52] U.S. Cl. ..... 368/67; 368/227; 368/285; 368/294

[58] Field of Search ..... 368/10, 67, 227, 368/276, 285, 294–295, 309

[56] References Cited

U.S. PATENT DOCUMENTS

| | | | |
|---|---|---|---|
| 3,078,364 | 2/1963 | Neugebauer . | |
| 3,114,236 | 12/1963 | Ross | 368/67 |
| 4,417,819 | 11/1983 | Migeon | 368/67 |
| 4,972,394 | 11/1990 | DiMarco | 368/227 |
| 5,099,462 | 3/1992 | Karowski . | |

FOREIGN PATENT DOCUMENTS

| | | |
|---|---|---|
| 706098 | 4/1985 | European Pat. Off. . |
| 2178547 | 11/1973 | France . |

*Primary Examiner*—Vit Miska

*Attorney, Agent, or Firm*—Sughrue, Mion, Zinn, Macpeak & Seas, PLLC

[57] ABSTRACT

Wristwatch including a case (1) for accommodating a movement (4), luminous elements carried by the bezel or by the middle part of said case, a source of energy (44, 45) and an electronic circuit (33) housed in said case to control the power supply of said luminous elements and at least one control element (5), characterized in that at least one luminous element is formed by a finger (11–15) made of flexible materials, supported by said case and extending beyond the latter.

8 Claims, 2 Drawing Sheets

19
14
16
15
13
12
11
20
17
18
15a
13a
23
14a
6
2
5
22
12a
11a
30
21
8
32
31
34
35
37
14b
15b
36
33
12b
38
13b
11b
40
47a
47
48
46
46a
45
44
42
44b
45b
44a
45a

TIMEPIECE INCLUDING LUMINOUS ELEMENTS

BACKGROUND OF THE INVENTION

The present invention concerns a timepiece including luminous elements, and more particularly such a timepiece of the wristwatch type in which at least one luminous element can permanently be seen.

Jewellery pieces or timepieces including luminous sources intended to produce either solely a decorative effect, or to provide in addition a determined piece of information, which may or may not relate to the time base in the case of a timepiece, are already known. In a non limiting manner, reference can be made to French Patent No 2 183 763, which discloses a decorative timepiece constituted for example by a watch whose bezel supports bulbs preferably of the electroluminescent type, said bulbs being able to be switched on or off by means of a switch. In British Patent No 2 218 895 the luminous sources are diodes embedded in the bezel of a wristwatch, or arranged on the periphery of the space between the dial and the crystal; the circular case then has a free ring of significant width for housing electric supply batteries and an electronic circuit allowing the lighting mode of the different diodes to be controlled via pressure on a push button. In British Patent No 2 204 429, the luminous sources have different colours and are connected to the time base to give a time indication.

The devices of the prior art have in common the fact that they are compact and generally voluminous and only produce a luminous effect to the extent that the light emitting source, which is completely integrated in the device, is not masked, as may be the case when a sleeve of a piece of clothing covers a wristwatch.

SUMMARY OF THE INVENTION

An object of the present invention is to overcome the drawbacks of this prior art by providing a timepiece comprising at least one luminous element, which may or may not represent time-related information, and which is easily visible, whatever the conditions of use of said timepiece, and in particular in the case of a wristwatch which will be taken by way of example in the description which follows.

The invention thus concerns a wristwatch including a case for accommodating a movement, luminous elements carried by the bezel or the middle part of said case, a source of energy and an electronic circuit housed in said case to control the power supply of the luminous elements, and a control element, characterised in that at least one luminous element is formed by a finger resting on said case and extending beyond the latter.

The control element may be a push-button carried by the middle part, or solely a connection allowing a control signal to be received from the movement.

According to a preferred embodiment, the finger-shaped luminous element is made of a flexible material, so as not to cause inconvenience to the user who wears the wristwatch on his wrist. This finger will be formed for example by a flexible tube or sheath, for example made of a plastic material, within which electric cables pass to supply diodes situated at the end of the finger.

Equally, the finger may be formed by a fibre optic or a fibre optic bundle having a luminous source at the base thereof. In the activated position, the finger will be lit along its entire length, with greater emerging intensity. The man skilled in the art may, without departing from the scope of the invention, adapt known devices allowing all or part of a flexible tubular element to be illuminated, for example by providing all or part of a flexible tube with electroluminescent elements.

The installation of one or more fingers may be carried out on the case in the middle part region, the finger then extending parallel to the general plane of the wristwatch. Such an arrangement may be useful as a complementary or additional visual alarm, for example for indicating the reception of a message on a "pager" type watch, whose electronic circuit would then be connected to the luminous element control circuit. In the use position, the finger may extend in a radial direction towards the hand, or may conversely be held folded over along the middle part by appropriate means when one does not wish to use it.

According to a preferred embodiment, the installation of several fingers is carried out on the bezel in a general direction perpendicular to the plane of the watch. When these luminous elements are provided solely for aesthetic purposes, i.e. when the circuit controlling the activation thereof is totally independent of the movement, there may be any number thereof, for example 3, 5 or more. When, conversely, these elements are provided to give or complete time-related information, the number thereof will be representative of a division of time, for example 4, 6 or more as a function of the density desired or available on the bezel.

However, in order to have an overall less voluminous device than those of the prior art, a number of fingers of between 3 and 6 will preferably be selected. For the same purpose of reducing the overall space requirement, the invention provides for the arrangement solely of the connection of the luminous elements, for example in the form of a printed circuit, under the bezel, and the arrangement of the source of energy and the electronic circuit in a housing forming an extension of the case and giving the wristwatch an overall ovoid shape.

The energy source is for example formed by two button type batteries arranged in a same plane and connected in series. The electronic circuit is preferably formed of an integrated microprocessor of a known type, able to be programmed to impose a sequence of lighting for the luminous elements and a total operating duration after actuation of a push-button.

The clockwork movement may be assembled according to known techniques by preparing for this purpose a case already including all the characteristic elements of the invention. The movement may also be pre-assembled in an independent container and then placed in the case and held in place by bonding or snap-fitting.

Other features and advantages of the present invention will appear during the following description of preferred embodiments, given by way of example, with reference to the attached drawings, in which:

DESCRIPTION OF PREFERRED EMBODIMENT

Figure 1:
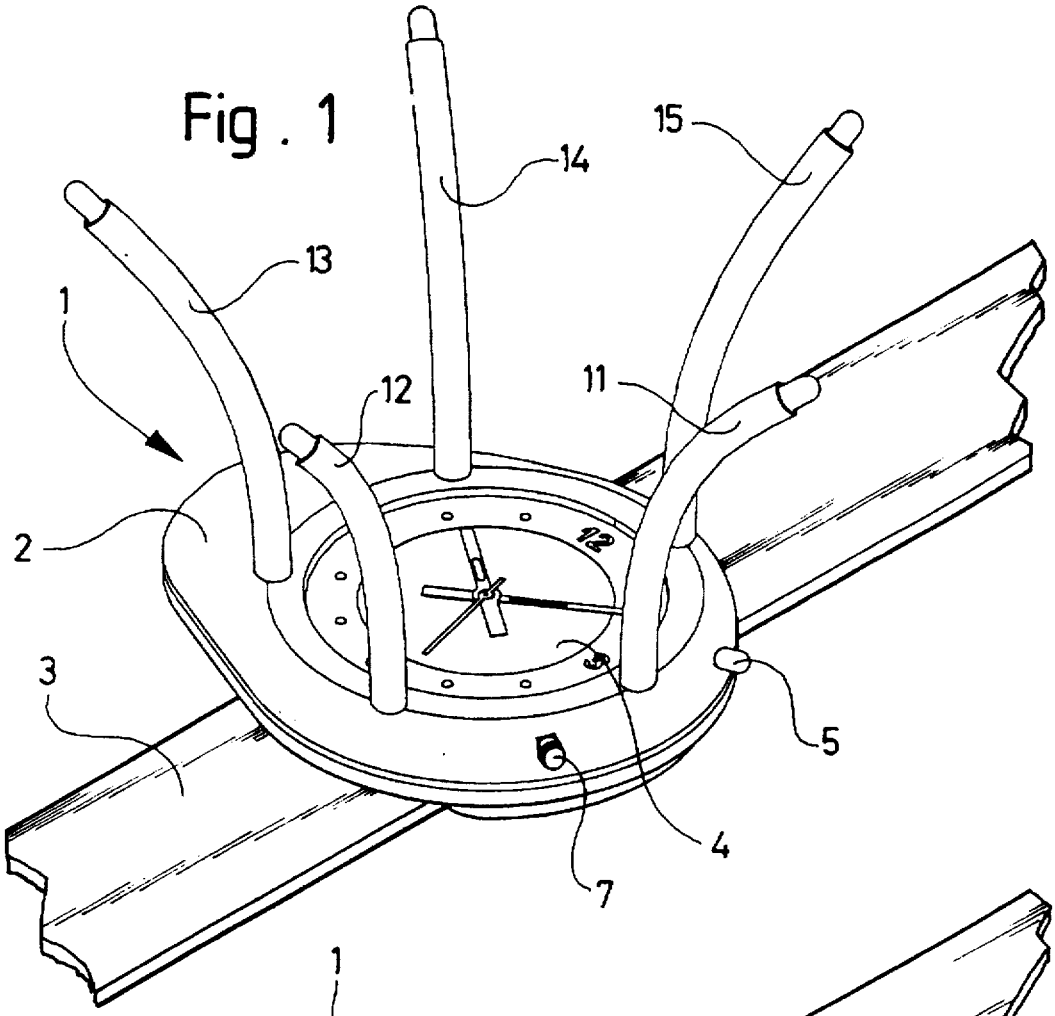
FIG. 1 is an overall perspective view of a wristwatch according to the invention including five luminous fingers.

Referring first to FIG. 1, the wristwatch shown includes in the usual manner a case 1, and a wristlet 3 in a single piece and which slides through a passage situated under the case. The central part of case 1 is occupied by a movement 4 which, in the example shown, has an analog display on a circular dial. The general shape of case 1 follows the periphery of the dial with the exception of a zone 2 substantially between 7h00 and 11h00 which has an extension and gives the case a general ovoid shape. The part of the case having the smallest radius of curvature is intended to accommodate an energy source and an electronic circuit, as will be explained hereinafter. The case is also provided with a push-button 5 and a movement time-setting crown 7. The wristwatch according to the invention is further characterised by the presence of five fingers 11 to 15, having a general direction perpendicular to the plane of case 1. These fingers are regularly spaced around the dial from the 3h00 position, and they have, from this position, lengths which increase clockwise. According to an alternative not shown, one may arranged only four fingers at the 3h00, 6h00, 9h00 and 12h00 positions, as indicated previously, embed fixed luminous markers in the bezel region for the other time positions and thus have a time indicator by effecting the appropriate connections between the time base of the movement and the electronic circuit.

Figure 2:
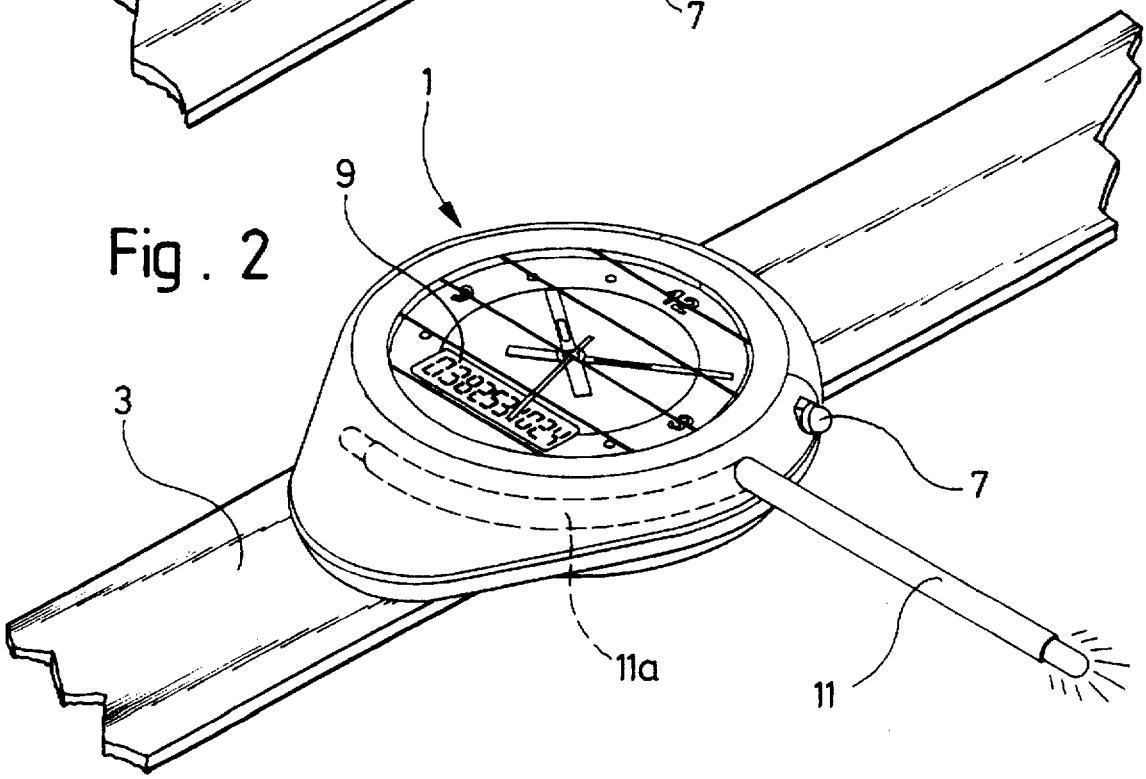
FIG. 2 is an overall perspective view of another embodiment including a single luminous finger.

In FIG. 2 the embodiment shown includes a single finger 11, fixed to the middle part so as to have a general direction parallel to the plane of the case. Since this finger is flexible, it may be bent along the middle part in the position 11*a* shown in dotted lines, held in this position by appropriate fixing means which are not shown and be deployed in accordance with the needs of the user, for example to form an additional or auxiliary luminous indicator in a pager type watch, to indicate reception of a message on a liquid crystal display screen 9.

Figure 3:
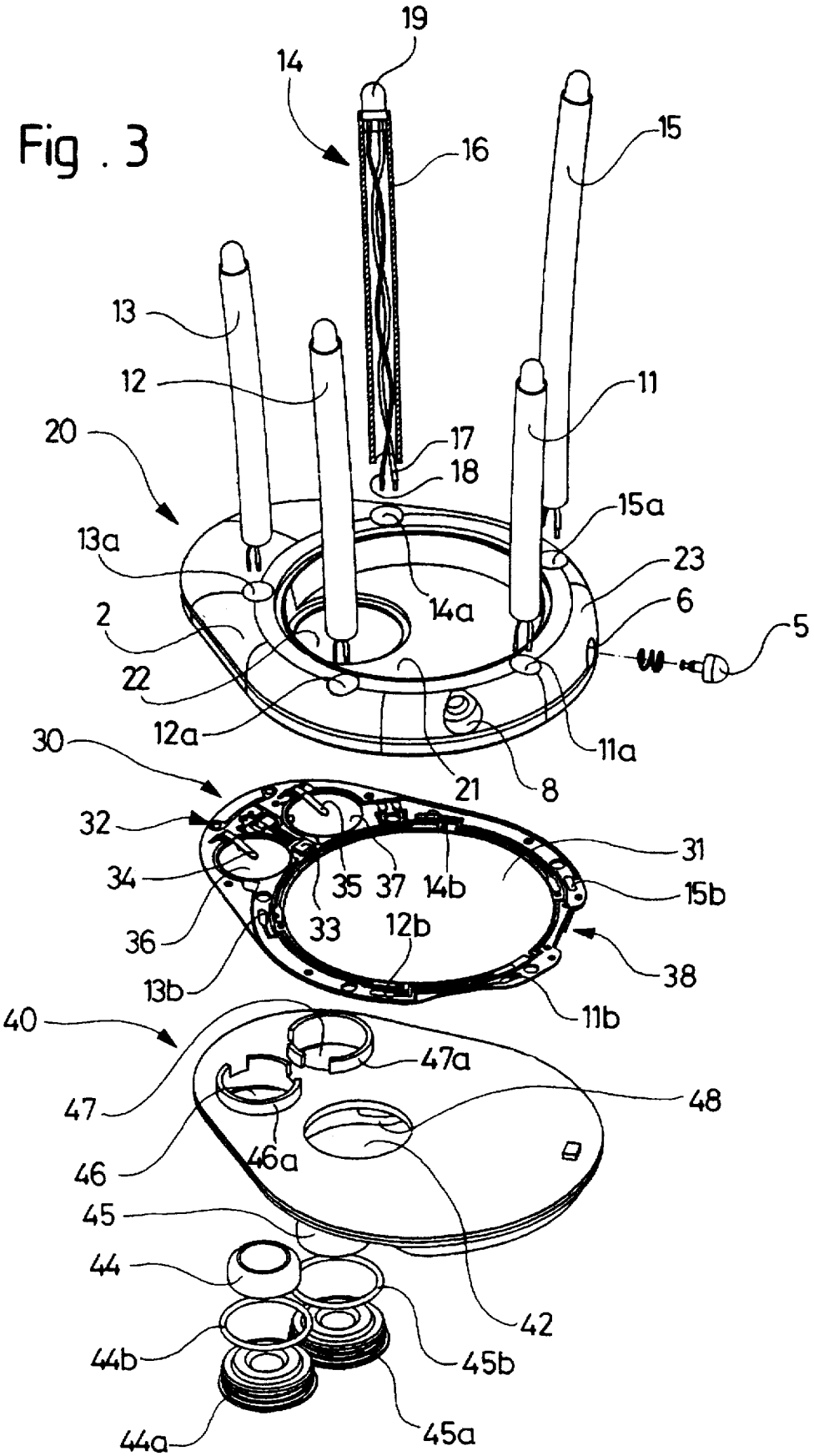
FIG. 3 is a blown up view corresponding to the embodiment of FIG. 1, the clockwork movement not being shown.

The exploded view of FIG. 3 gives a construction example of the embodiment shown in FIG. 1, the pre-assembled type clockwork movement not yet being set in place. Case 1 includes three essential parts, namely an upper case 20, a printed circuit 30 and a lower cover 40. Case 20 and cover 30 are obtained by moulding or injection moulding a plastic material and may easily be assembled via bonding or ultrasound bonding to hold printed circuit 30 in place. The external part of case 20 includes a circular central recess 21 intended to accommodate a movement, the bottom of said recess 21 including an opening 22 allowing access to the movement battery compartment. The part forming middle part 23 includes a passage 6 for the push-button 5 and a passage 8 for the stem of the time-setting crown 7. In the lower part of case 20, a recess is provided on the periphery and in the ovoid extension 2 for accommodating printed circuit 30. The hour circle includes finally five holes 11*a* to 15*a* passing through said case 20 in the bezel region to allow fingers 11 to 15 to be set in place and the connection thereof to printed circuit 30. As FIG. 3 shows, finger 14 is shown in cross-section. It is formed of a flexible tube or sheath 16 made of a plastic material, such as Tygon®, within which two twisted electric conductors 17, 18 pass, connected at their emerging end to a diode 19 attached to the tube via bonding. It will be observed that such an arrangement has the advantage of allowing an infinity of variations to be achieved simply and economically by acting simply, on the one hand on the choice of colours for the tubes, the diodes and the electric conductors, and on the other hand on the lengths and installations of each finger. It is thus possible to achieve series production in which each model can nonetheless be personalised. By way of example, for each finger one of the conductors may have the same colour as the diode, the other conductors being white and the tubes transparent.

Printed circuit 30, shown schematically in FIG. 3, includes the elements known to the man skilled in the art for supplying in accordance with a programmed sequence contacts 11*b* to 15*b* onto which the respective conductors of each finger will be bonded. These contacts are distributed over a strip surrounding a circular opening 31 of slightly greater diameter to recess 21 and are connected by conducting strips to part 32, corresponding to ovoid extension 2 of the case and including an integrated microprocessor 33 and means 34, 35 for connection to button type batteries 44, 45 arranged in openings 36, 37 and forming the energy source necessary for the supply of the diodes. Printed circuit 30 includes finally a contact device having a strip 38 able to be actuated by push-button 5, and allowing the diodes situated at the end of the fingers to be flashed one after the other for approximately 30 seconds. To facilitate comprehension, the elements of the circuit have been shown on the surface of the printed circuit oriented towards case 20, but equally, and even preferably, they may be arranged on the surface oriented towards the side of the cover.

Generally flat-shaped cover 40 has the same ovoid periphery as case 20. It includes an opening 42, facing opening 22 of the case, to allow passage of the movement battery, and two other openings 46, 47 extended by flanges 46*a*, 47*a* facing openings 36, 37 of the printed circuit to allow passage of supply batteries 44, 45 for the luminous device. In its external part, the cover includes a bracket 48 (partially visible in FIG. 3) for the passage of the wristlet, said bracket also including an opening for passage of the movement battery.

Finally, caps 44*a*, 45*a* and sealing gaskets 44*b*, 45*b* which allow the supply batteries to be held in place are shown.

The examples which have just been described are capable of numerous variations and adaptations within the reach of the man skilled in the art without departing from the scope of the invention.

What is claimed is:

1. A wristwatch including a case for accommodating a movement, luminous elements carried by the bezel or by the middle part of said case, a source of energy and an electronic circuit housed in said case to control the power supply of said luminous elements, and at least one control element, wherein at least one luminous element is formed at the end of a flexible finger supported by said case and extending beyond the latter.

2. A wristwatch including a case for accommodating a movement, luminous elements carried by the bezel or by the middle part of said case, a source ot energy and an electronic circuit housed in said case to control the power supply of said luminous elements, and at least one control element, wherein at least one luminous clement is formed by a finger made of flexible materials, supported by said case and extending beyond the latter; and wherein said finger is formed of a flexible plastic tube or sheath within which pass electric cables to supply a diode situated at the end of the finger.

3. A wristwatch according to claim 1, wherein each finger is formed by a bundle of fibre optics.

4. A wristwatch according to claim 1, wherein all the luminous elements are formed by flexible fingers extending in a general direction perpendicular to the plane of the case from the bezel.

5. A wristwatch including a case for accommodating a movement, luminous elements carried by the bezel or by the middle part of said case, a source of energy and an electronic circuit housed in said case to control the power supply of said luminous elements, and at least one control element, wherein at least one luminous element is formed by a finger made of flexible materials, supported by said case and extending beyond the latter; and, wherein said finger extends in a general direction parallel to the plane of the case from the bezel.

6. A wristwatch according to claim 1, wherein the case has a general ovoid shape, whose part having the smallest radius of curvature houses the energy source and the electronic circuit.

7. A wristwatch according to claim 1, wherein the control element is a push-button carried by the middle part.

8. A wristwatch according to claim 1, wherein the control element is a contact allowing a control signal to be received from the movement.

* * * * *